US007131873B2

(12) United States Patent
Miyake et al.

(10) Patent No.: US 7,131,873 B2
(45) Date of Patent: Nov. 7, 2006

(54) ELECTRICAL CONNECTOR CAPABLE OF PREVENTING PLUGGING ERROR

(75) Inventors: Yukinori Miyake, Tokyo (JP); Kenji Kawamura, Tokyo (JP); Tsuyoshi Nakagawa, Tokyo (JP); Tetsuya Ozaki, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 13 days.

(21) Appl. No.: 10/720,389

(22) Filed: Nov. 25, 2003

(65) Prior Publication Data

US 2004/0110425 A1 Jun. 10, 2004

(30) Foreign Application Priority Data

Nov. 25, 2002 (JP) ..... 2002-340605

(51) Int. Cl.
*H01R 13/64* (2006.01)

(52) U.S. Cl. ..... 439/680

(58) Field of Classification Search ..... 439/680, 439/677, 674, 357, 358
See application file for complete search history.

(56) References Cited

U.S. PATENT DOCUMENTS

| | | | | |
|---|---|---|---|---|
| 6,250,947 | B1 | 6/2001 | Holzer | |
| 6,383,031 | B1 * | 5/2002 | Law et al. | 439/680 |
| 6,517,387 | B1 * | 2/2003 | Huang | 439/680 |

FOREIGN PATENT DOCUMENTS

| | | |
|---|---|---|
| DE | 20100359 | 6/2001 |
| JP | 6-60077 | 8/1994 |
| WO | WO 01 13484 | 2/2001 |

* cited by examiner

*Primary Examiner*—Tho D. Ta
(74) *Attorney, Agent, or Firm*—Takeuchi&Kubotera, LLP

(57) ABSTRACT

An electrical connector, comprising a housing body having a tubular plugging face for plugging in a mating connector, the tubular plugging face (12) having a sectional shape of substantially square (14) with respect to a sectional plane perpendicular to a direction of plugging into the mating connector, the tubular plugging face including a square tubular portion (13) and a cylindrical portion (14), wherein the square tubular and cylindrical portions have sectional shape of a square and a circle, respectively, with respect to the sectional plane, which are overlapped with each other, and at least one key (32A) or at least one key groove (14A) for preventing a plugging error, the key or key groove provided in the cylindrical portion.

8 Claims, 5 Drawing Sheets

ELECTRICAL CONNECTOR CAPABLE OF PREVENTING PLUGGING ERROR

BACKGROUND OF THE INVENTION

1. Field of the Invention

The present invention relates to an electrical connector capable of preventing plugging error with any connector other than a mating connector.

2. Description of the Related Art

This kind of connector is disclosed, for example, in Japanese Patent Application Kokai Number 6-60077 (Patent Document 1).

The convention connector has a plugging face which has a sectional shape of oblong square tube taken along the plane perpendicular the plugging direction. A rugged portion is provided at a corner of the upper surface of the plugging face to prevent plugging error. The connector comprises coaxial cables at ends in the horizontal direction and a plurality of signal terminals arranged between the coaxial cables.

In the convention connector, however, there have been problems in terms of manufacturing accuracy and plugging deviation caused by the plugging face having the shape of square tube.

A molding die for the housing requires two directional dimensions, vertical and horizontal dimensions with respect to the plane perpendicular to the plugging direction, for the square tubular shape. Accordingly, dimensional errors in the two directions are possible. Consequently, the dimensional error of the conventional connector is larger than that of other connector having a cylindrical shape which requires only one dimension, a radius from the center.

In the conventional connector with the square tubular shape, when plugged with the mating connector, even if the connectors fit in each other in the vertical direction, a plugging error is possible because of the plugging deviation in the horizontal direction. However, in case of a connector with the cylindrical plugging shape, even if there is a plugging deviation in the horizontal error, the plugging deviation of a certain part of the plugging face is small and the amount of the plugging deviation is changing continuously from the part of the small deviation so that it is possible to lead to proper plugging without plugging deviation by correcting the deviation at that part.

As described above, the conventional connector having the plugging face of square tubular shape has a large error in the manufacturing accuracy and no correction capability for the plugging deviation. Accordingly, unless a key groove for a key is made sufficiently large to absorb the manufacturing error and plugging deviation, the smooth plugging is impossible. However, when a plurality of keys are necessary, it is impossible to provide many keys densely in a limited area because the respective keys require a sufficient interval between each other.

SUMMARY OF THE INVENTION

Accordingly, it is an object of the present invention to provide an electrical connector capable of accurate manufacture and permitting plugging with a small deviation or preventing a plugging error, wherein a small plugging deviation is corrected.

An electrical connector capable of preventing a plugging error according to the invention comprises a housing body having a tubular plugging face for plugging in a mating connector, wherein the tubular plugging face has a sectional shape of substantially square with respect to a sectional plane perpendicular to a direction of plugging into the mating connector and at least one key or at least one key groove for preventing a plugging error, which is provided in the surface of the tubular plugging face.

In the electrical connector, the tubular plugging face includes a square tubular portion and a cylindrical portion, wherein the square tubular and cylindrical portions have sectional shape of a square and a circle, respectively, with respect to the sectional plane, which are overlapped with each other. The key or the key groove is provided in the cylindrical portion.

The electrical connector has the cylindrical and square tubular portions in the tubular plugging face. The manufacturing accuracy of the cylindrical portion is better than that of the square tubular portion because the dimensional accuracy of the molding die of the cylindrical portion is determined only by the measurement of the dimension of the radius direction, while that of the square tubular portion is determined by the measurement of two directional dimensions, vertical and horizontal dimensions. When the plug is attempted with the deviation in vertical or horizontal direction, the amount of the deviation of the cylindrical portion is continuously changed gradually from a position of a smaller deviation to a position of larger deviation, if viewed from the circumferential direction. Accordingly, the plugging faces of the connectors are guided by each other to appropriate positions, enabling an easy plugging. If the plugging face has only the cylindrical portion, the deviation in the circumferential direction would cause a problem. However, the plugging face according to the present invention has the square tubular portion too so that the deviation in the circumferential direction does not occurs largely. Accordingly, the key and key groove are aligned to proper positions, respectively, and plugged in each other easily.

In the electrical connector according to the invention, the tubular plugging face can include at least one additional key or at least one additional key groove provided in the square tubular portion. Even in this case, the key and key groove are positioned properly so that the connector can be plugged in a proper mating connector, while the plug-in with a connector other than the proper mating connector is prevented by the difference in the positions of the key and key groove.

One of the electrical connectors is a plug connector having a plugging projection section, wherein the tubular plugging face is provided in an outer surface of the plugging projection section, and the key groove is provided in an outer surface of the cylindrical portion. The other of the electrical connectors is a receptacle connector having a plugging cavity section, wherein the tubular plugging face is provided on an inner surface of the plugging cavity section, and the key is provided in an inner surface of the cylindrical portion.

According to the invention, the cylindrical portion can accommodate a coaxial terminal which is concentric with the cylindrical portion. In this case, it is preferable that the coaxial terminal comprises a cylindrical outer conductor and a projection extending in a plugging direction of the outer conductor, wherein a groove for receiving the projection is provided in a coaxial terminal of the mating connector. A plugging error can be prevented by the projection and the groove too.

Also, the connector can comprise a flexible lock arm which is provided outside a region of the cylindrical portion but inside a region of the square tubular portion, extends in the plugging direction, and has a lock engagement claw at a top end thereof. In addition, the square tubular portion can accommodate a signal terminal between cylindrical portion and the flexible lock arm. The connector does not become large by providing the signal terminal.

BRIEF DESCRIPTION OF THE DRAWINGS

FIG. 2 is a front view of the plug connector of FIG. 1.

FIG. 3 is a vertically sectional view of the connectors of FIG. 1 before plugged in.

FIG. 4 is a horizontally sectional view of the connectors of FIG. 1 before plugged in.

DESCRIPTION OF THE PRFERRED EMBODIMENTS

An embodiment of the present invention will now be described with reference to the accompanying drawings.

Figure 1:
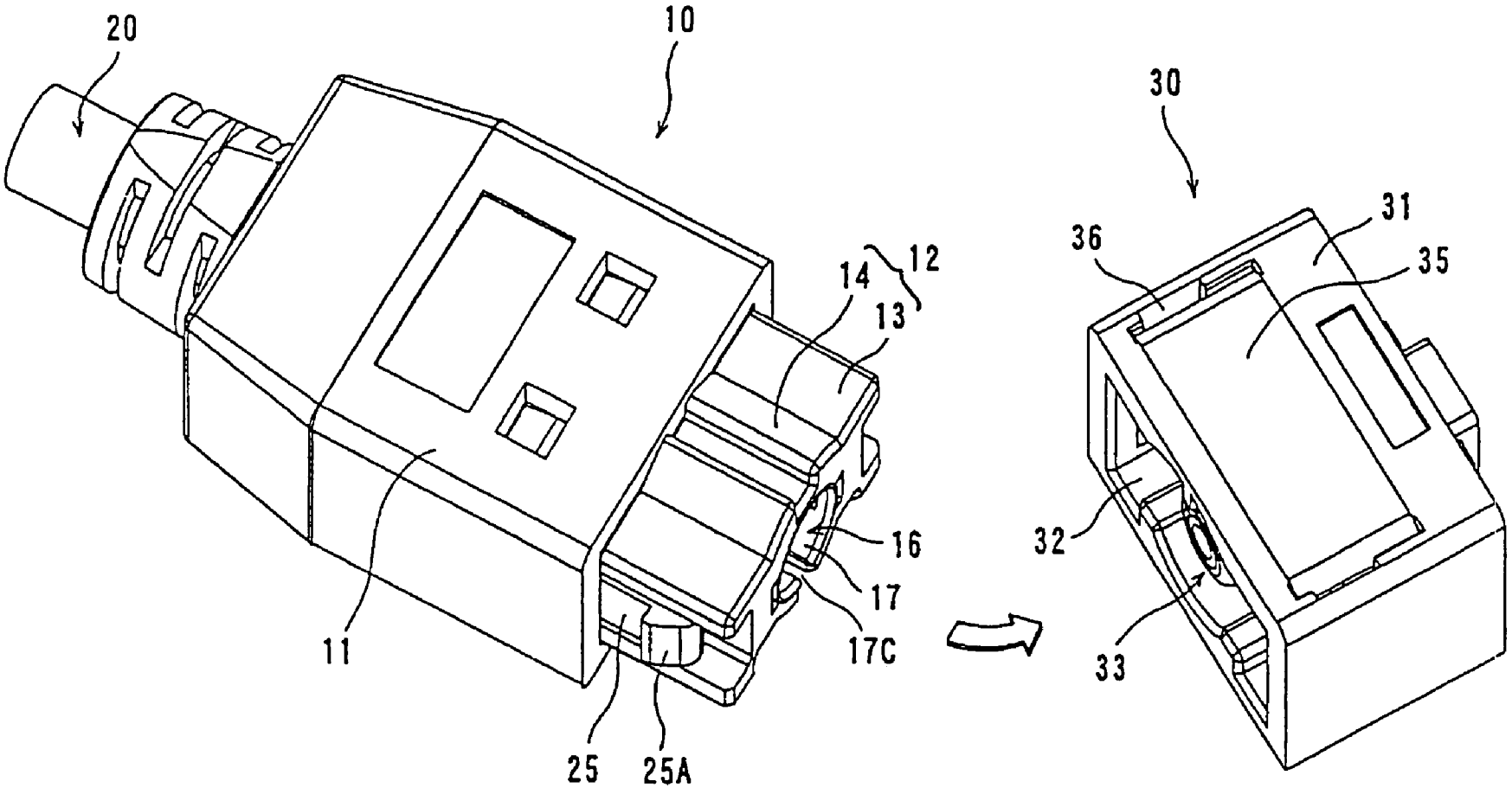
FIG. 1 is a perspective view of plug and receptacle connectors according to an embodiment of the present invention before plugged in each other.
Figures 2, 3:
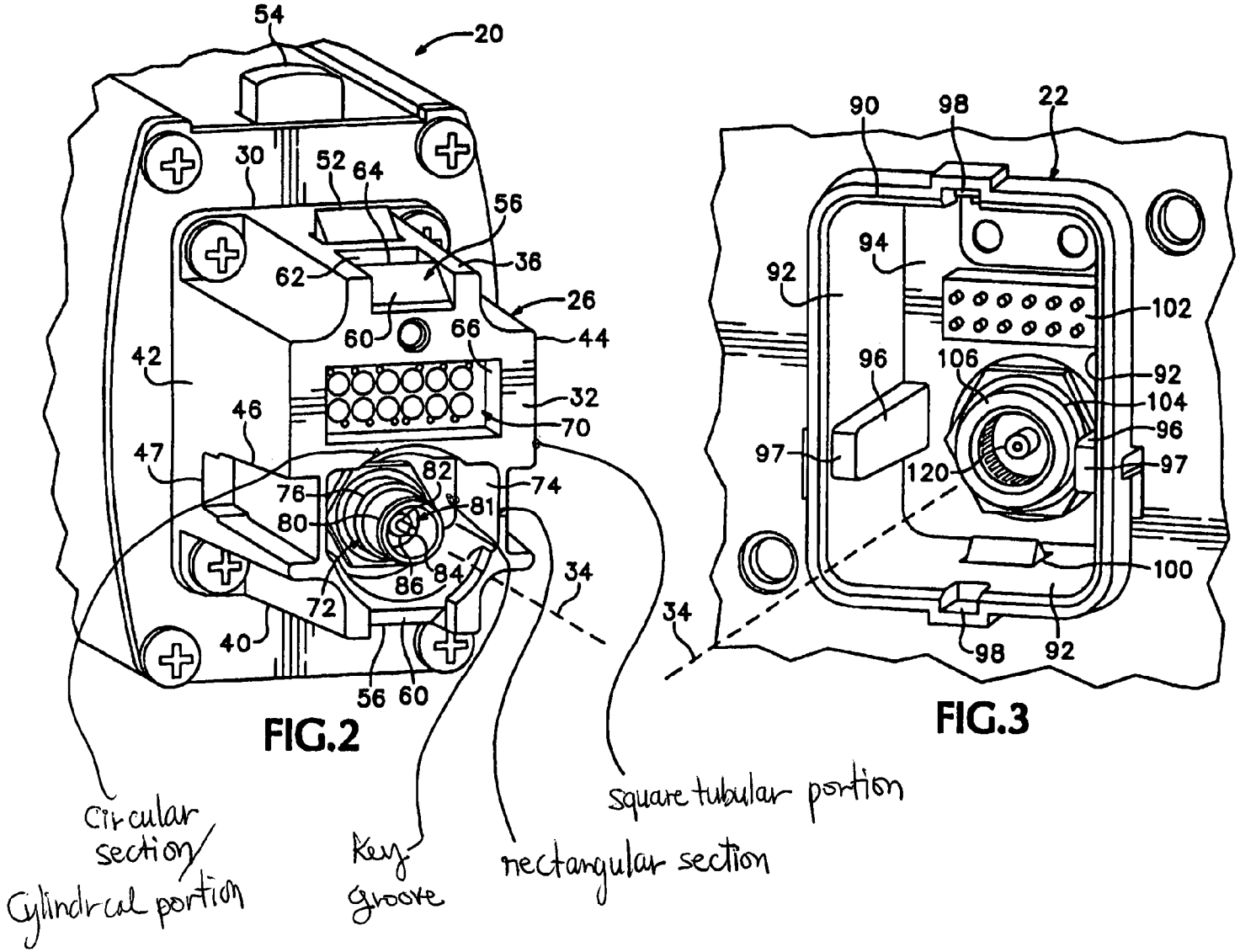
Figure 4:
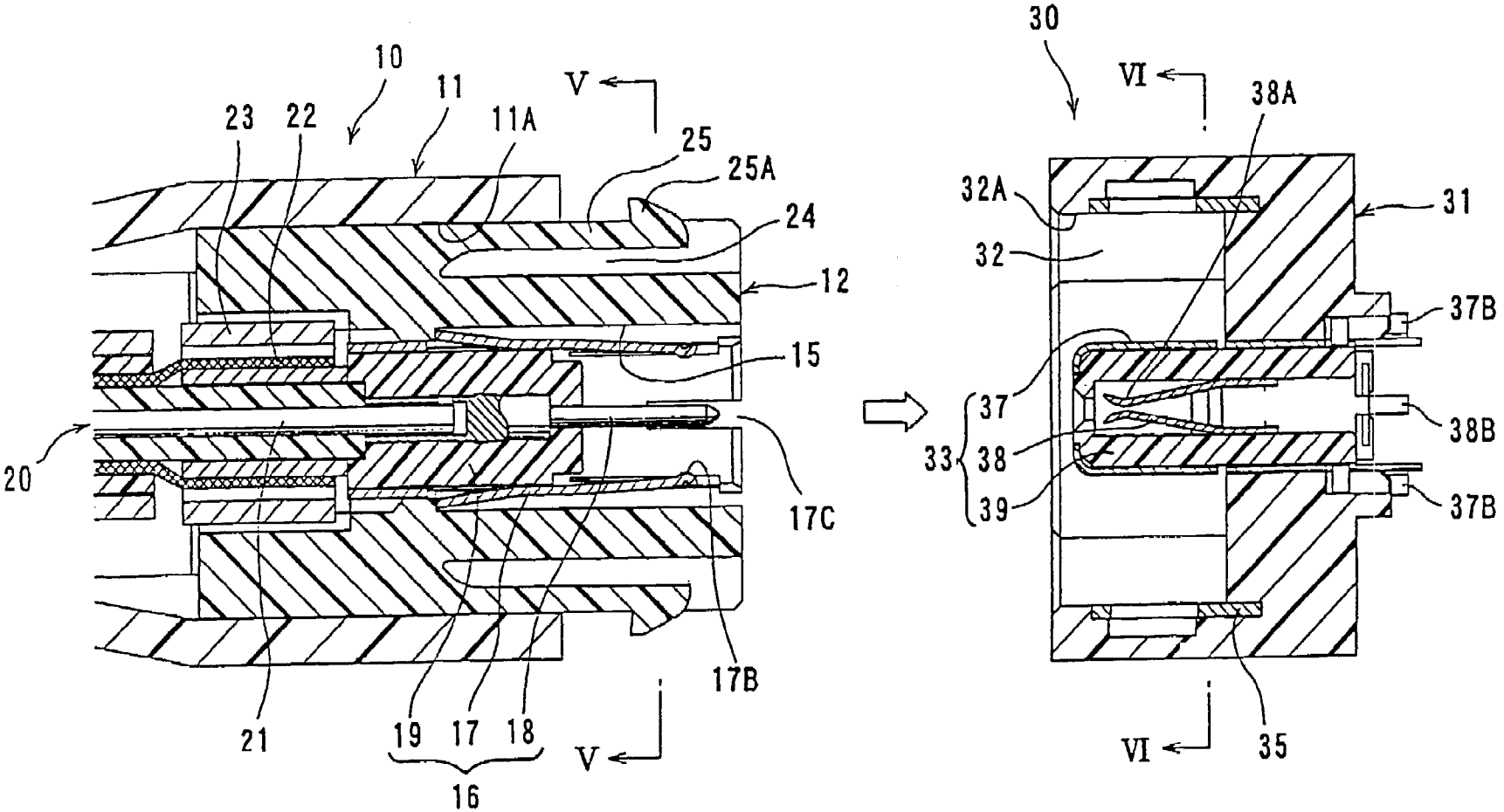
Figure 5:
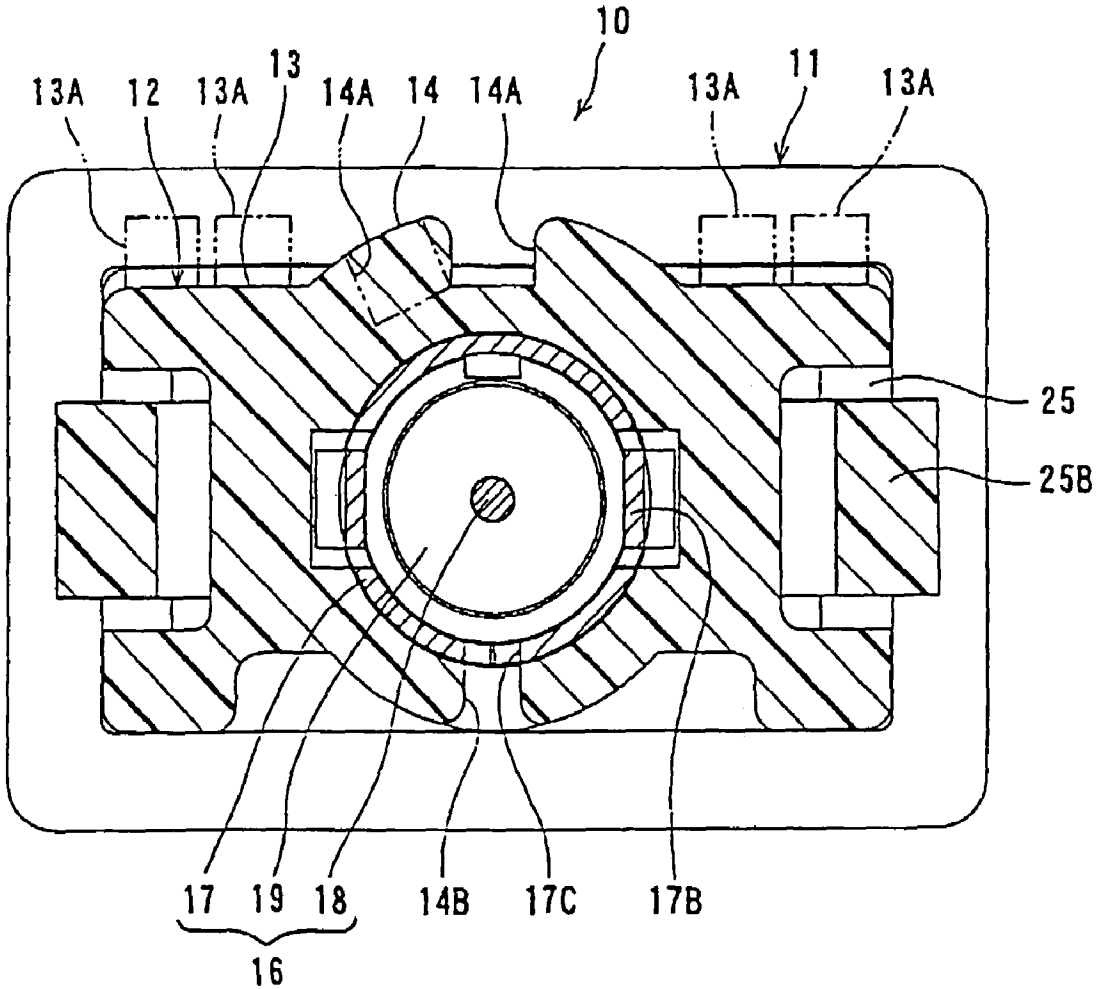
FIG. 5 is a sectional view of the connectors taken along the line V—V of FIG. 4.
Figure 6:
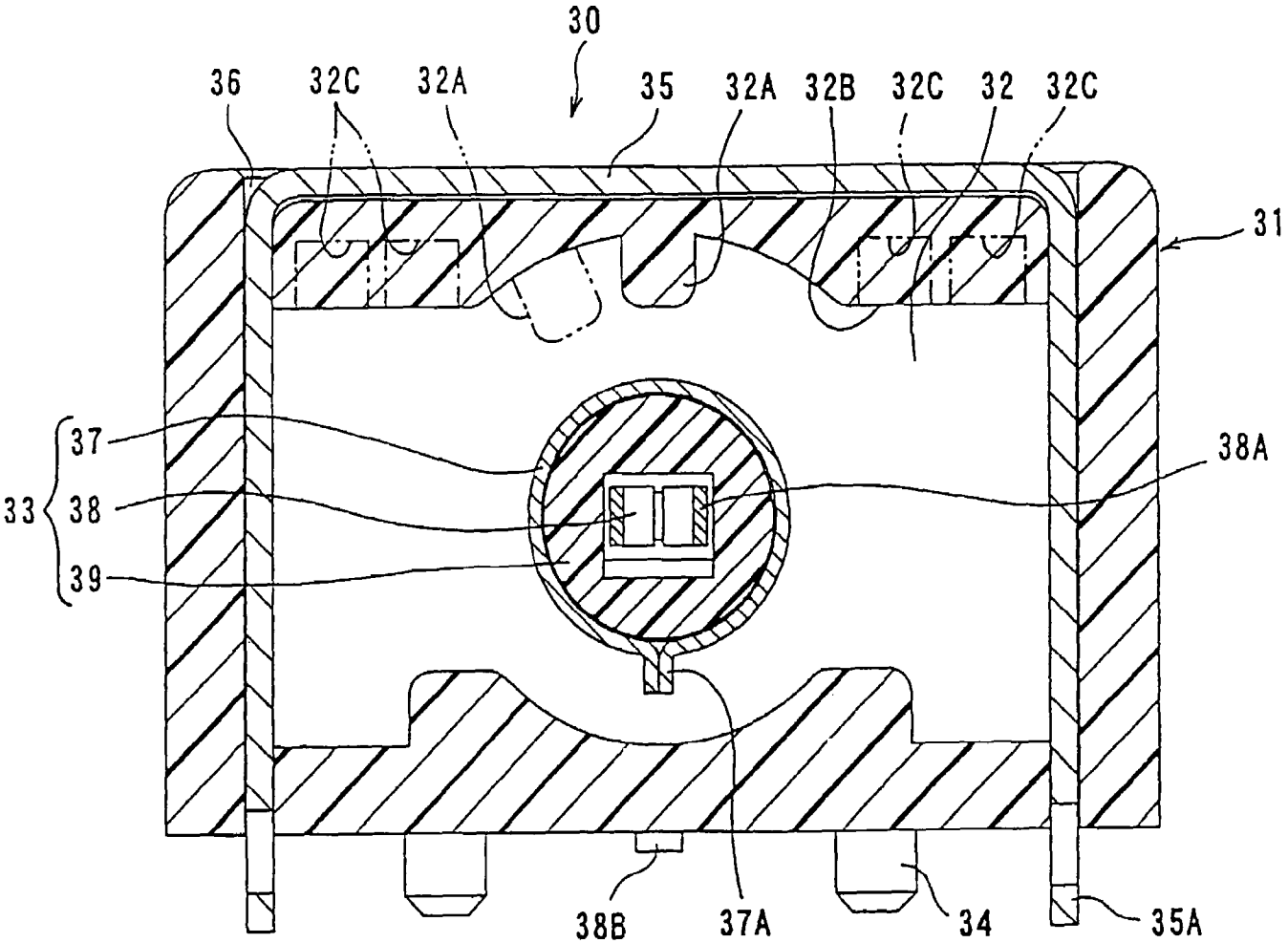
FIG. 6 is a sectional view of the connectors taken along the line VI—VI of FIG. 4.

FIG. 1 is a perspective view of a plug connector 10 and a receptacle connector 30 according to an embodiment of the invention, wherein each of the connectors is a mating connector to the other. FIG. 2 is a front view of the plug connector of FIG. 1. FIGS. 3 and 4 are vertical and horizontal sectional views, respectively, of both the connectors of FIG. 1 before plugging. FIGS. 5 and 6 are sectional views of FIG. 4 taken along with the lines V—V and VI—VI, respectively.

In the drawings, the plug connector 10 comprises a housing body 11 made of an electrically insulating material and a plugging protruding member 12 provided on the front side in the plugging direction. The housing body 11 has a substantially rectangular parallelepiped. The housing body 11 has a hollow thereinside, which is opened forward and backward (the plugging direction with the mating connector is defined as forward). A front opening 11A of the housing body 11 has a shape and dimension suitable for receiving and holding the plugging protruding member 12.

The rear side of the plugging protruding member 12 is plugged in the front opening 11A and the front side projects forwardly from the front opening 11A to form a projecting plug section. The periphery of the plug section is a plugging face for the mating connector or the receptacle connector 30. The sectional shape of the front periphery of the plugging protruding members 12 taken along a plane perpendicular to the plugging direction includes a rectangular or square section in which its width is greater than its height and a circular section with its diameter being greater than the height of but smaller than the width of the rectangular section. The circular section overlaps the central portion of the rectangular section. Accordingly, the plugging protruding member 12 contains a square tubular portion 13 and a cylindrical portion 14.

An angular key groove 14A and a groove 14B are provided at the upper and lower centers, respectively, of the periphery of the cylindrical portion 14 in the horizontal direction in FIG. 1. A plugging cavity 15 is provided at the center of the cylindrical portion 14 and forms a concentric circle with the periphery of the cylindrical portion 14, extending through in the back-and-forth direction. A coaxial connector 16 having a coaxial terminal is accommodated and held in the plugging cavity 15. The coaxial connector 16 comprises a substantially cylindrical outer conductor 17 made of a metal sheet, a pin-shaped central conductor 18 provided at the center thereof, and an insulating member 19 provided between the outer and central conductors 17 and 18.

The outer conductor 17 forms a space 17A for receiving the receptacle connector 30 at the front side thereof, and the central conductor 18 projects forwardly from the space 17A. The outer conductor 17 comprises a plurality of spring contacts 17B and a cut-off portion 17C. The cut-off portion 17C is provided at positions corresponding to that of the groove 14B of the housing body and extend in axial direction.

The central conductor 18 is connected to a conductor 21 of a coaxial cable 20 at the rear side thereof and the outer conductor 17 is press-held by a metal holder 23 and connected to with a shield wire 22 of the coaxial cable 20.

The plugging protruding member 12 has the square tubular portions 13 on the sides of the cylindrical portion 14 in the horizontal direction in FIG. 1. As shown in FIG. 4, ditches 24 are provided at sides of the square tubular portions 13 to provide flexible lock arms 25 extending forwardly long. A lock engagement claw 25A projecting outwardly is provided at the front end of each flexible lock arm 25. When plugged with the receptacle connector 30, the flexible lock arm 25 flexes toward the groove 24 so that the lock engagement claws 25A engage the corresponding portions of the receptacle connector 30 to prevent the connectors 10 and 30 from coming off.

The receptacle connector 30 comprises a plugging cavity 32 provided in a housing body 31 thereof for receiving the front portion, which projects from the housing body 11, of the plugging protruding member 12 of the plug connector 10. That is, the plugging cavity 32 has an internal circumference 32B which fits the square tubular and cylindrical portions 13 and 14 of the periphery of the plugging protruding member 12, and a key 32A at the upper part of the internal circumference 32A, which is plugged in the key groove 14A of the plug connector 10. A female coaxial connector 33 having a female coaxial terminal projects to the plug space 32 for connection with the coaxial connector 16 of the plug connector 10.

In FIG. 6, the housing body 31 is provided with a attaching legs 34 on the bottom face thereof and a shield plate 35 to cover the circumference of the housing body 31 except for the bottom face. The shield plate 35 is inserted into a groove 36 provided insides the side walls of the housing body 31 so that the outer face of the shield plate 35 is exposed to the outside the upper face of the housing body 31 and the inner face of the shield plate 35 is exposed to the plugging cavity 32 at the side faces of the housing body 31. The shield plate 35 comprises a connection portion 35A which projects from the lower face of the housing body 31.

The coaxial connector 30 of the receptacle connector 30 comprises a substantially cylindrical outer conductor 37 made of a metal sheet, a central conductor 38 having a contact piece 38A at the center thereof, and an insulating member 39 provided between the outer and central conductors 37 and 38. A protruding portion 37A is provided at the lower joined portion of the outer conductor 37 and guided into the groove 14A of the plug connector 10 and the cut-off portion 17C of the outer conductor 17. A connection portion 37B is provided at the rear side of the outer conductor 37 and bent downwardly to be connected to a circuit board (not shown) by soldering. The central conductor 38 comprises a pair of contact portions 38A which are opposed to each other and receive the central conductor 18 of the plug connector 10 to be brought into resilient contact with it. A connection portion 38B is provided at the rear side of the central conductor 38 and projects outside the housing body 31 to be connected to a circuit board (not shown) by soldering.

The plug and receptacle connectors 10 and 30 are used in the following manner.

Prior to the plug of both the connectors, the coaxial cable 20 is connected to the plug connector 10, the receptacle connector 30 is arranged at appropriate position on the circuit board by the attachment legs 34, and the connection portions 35A and 38B of the shield plate 35 and central conductor 38 are connected to corresponding traces of the circuit board by soldering, respectively.

When the receptacle connector 30 is plugged in the plug connector 10, the front portion of the plugging protruding member 12 of the plug connector 10 is aligned to the corresponding portion of the plugging cavity 32 of the receptacle connector 30. Since the square tubular portion 14 project largely from the cylindrical portion 14 in the horizontal direction, it is rare that the receptacle connector 30 is plugged in the plug connector 10 with large inclination in the surrounding directions of the axis of the central conductor 18. This is because if the large inclination occurs, the vertical displacement at both sides of the square tubular portion 13 is extremely large so that it is visibly found and corrected immediately. On the other hand, it is possible that the connectors 10 and 30 are about to be plugged in each other with slight deviation in vertical or horizontal direction.

In the manufacture of the plug connector 10 by molding, two dimensions, in the vertical and horizontal directions in the plane perpendicular to the plugging direction, are measured for the square tubular portion 13, and one dimension in radius direction is measured for the cylindrical portion 14. Accordingly, the dimensional accuracy of the cylindrical portion 14 is made better than the square tubular portion 13.

When the plug is attempted with the slight deviation in vertical or horizontal direction, two circles, that is, the cylindrical portion 14 of the plug connector 10 and the corresponding portion of the receptacle connector 30, are overlapped with slight deviation of the centers of the two circles. The amount of the deviation is continuously changed gradually from a position of a smaller deviation to a position of larger deviation, if viewed from the circumferential direction. Accordingly, the connectors 10 and 30 are guided by each other to appropriate positions, where both the centers are completely consistent, at the position of smaller deviation and its vicinity. Moreover, the cylindrical portion 14 is made relatively accurate so that it is aligned to the appropriate position immediately to be plugged. As the positioning of the cylindrical portion 14 is easily made, the position of the square tubular portion 13 is also corrected. Consequently, the key 32A of the receptacle connector 30 is plugged in the key groove 14A properly. Similarly, the protruding portion 37A of the receptacle connector 30 is plugged in the groove 14B.

Thus, even if a different connector other than the proper mating connector is attempted be to be plugged in, the plugging error is prevented by the key and key groove. Even more, with the proper mating connector, a little plugging deviation is corrected and the connectors are guided to appropriate positions.

Modifications of the present invention are possible.

As shown by two-dot chain lines in FIGS. 2, 5, and 6, the key groove 14A and the key 32A are provided at different positions in the circumferential direction instead of the center of the cylindrical portion 14 and its corresponding position of the receptacle connector 30. As a matter of course, the number of them is not limited. The key and key groove 14A and 32A may extend toward the center of the cylindrical portion 14. Moreover, additional key 13A and the key groove 32A may be provided on the upper face of the square tubular portion 13 and its corresponding position in the internal circumference 32B of the receptacle connector 30, respectively, utilizing differences in the heights from the cylindrical portion 14 and the internal circumference 32B. In this case, since the square tubular portion 13 has the flexible arms 25 on both the side thereof and no sufficient space to provide a groove, it is preferable that the key 13A is made to project. The numbers and positions of the additional keys and key grooves can be determined freely. Since many options for the numbers and positions of the keys and key grooves are possible without increasing the size of the connectors, many kinds of pairs of connectors can be designed. In addition, since the cylindrical portion can be made precisely, even when the connectors are plugged in each other with a little deviation, they are guided to appropriate positions. Accordingly, even if the keys and key grooves are made close to each other because of many numbers, the deviation does not disturb the plug.

As shown by two-dot chain lines in FIG. 2, other signal terminals 26, such as signal terminals, are provided to utilizing a space in the square tubular portion.

When an additional key is provided in a connector, a key groove corresponding to the key is provided in the other connector, and when a signal terminal is provided in the square tubular portion, the signal terminals of both the connectors are provided such that they can be plugged in each other or brought into sliding contact with each other.

As described above, the connector comprises the square tubular portion and cylindrical portion, wherein a square and a circle thereof are overlapped with each other in the sectional plane perpendicular to the plugging direction, so that the dimensional accuracy is increased in the manufacture because of the cylindrical portion. Also, even when a plug is attempted with positioning deviation, the deviation of the cylindrical portion can be easily corrected and the deviation of the square tubular portion can be corrected after the correction of the deviation of the cylindrical portion, thus enabling the plug at appropriate positions. Many keys to prevent a plugging error can be provided in a limited space, and even if there is a positioning deviation, the deviation does not disturb the plugging-in because the deviation is corrected in the manner described above.

The invention claimed is:

1. An electrical connector, comprising:

a housing body having a tubular plugging face for plugging to a mating connector, said tubular plugging face including a square tubular solid portion having a substantially rectangular section in a plane perpendicular to said plugging direction and a cylindrical solid portion having an annular section in said plane, said rectangular section having a height and a width, said height being smaller than said width, said annular section having an outside diameter greater than said height of but smaller than said width of said rectangular section and overlapping a central portion of said rectangular section in said plane; and at least one key or key groove provided on or in said cylindrical portion for preventing a plugging error to said mating connector.

2. The electrical connector according to claim 1, wherein said tubular plugging face includes at least one additional key or key groove provided on or in said square tubular portion.

3. The electrical connector according to claim 1 or 2, wherein said electrical connector is a plug connector having a plugging projection section, said tubular plugging face is provided on an outer surface of said plugging projection section, and said key groove provided in an outer surface of said cylindrical portion.

4. The electrical connector according to claim 1 or 2, wherein said electrical connector is a receptacle connector having a plugging cavity section, said tubular plugging face is provided on an inner surface of said plugging cavity section, and said key is provided on an inner surface of said cylindrical portion.

5. The electrical connector according to claim 1 or 2, wherein said cylindrical portion accommodates a coaxial terminal which is concentric with said cylindrical portion.

6. The electrical connector according to claim 5, wherein said coaxial terminal comprises a cylindrical outer conductor and a projection extending in a plugging direction of said outer conductor, wherein a groove for receiving said projection is provided in a coaxial terminal of said mating connector.

7. The electrical connector according to claim 3, wherein said plug connector comprises at least one flexible lock arm provided outside said cylindrical portion but inside said square tubular portion, extending in said plugging direction, and having a lock engagement claw at a front end thereof.

8. The electrical connector according to claim 7, wherein said cylindrical portion accommodates a coaxial terminal which is concentric with said cylindrical portion and said square tubular portion accommodates a signal terminal between cylindrical portion and said flexible lock arm.

* * * * *